US005324211A

United States Patent [19]

Siemon et al.

[11] Patent Number: 5,324,211

[45] Date of Patent: Jun. 28, 1994

[54] MATERIAL REDUCED, TRANSMISSION ENHANCED CONNECTING BLOCK AND CLIP AND METHOD OF MANUFACTURE THEREOF

[75] Inventors: John A Siemon, Woodbury; Howard Reynolds, Plainville, both of Conn.; John J. Rozmus, Berwyn; Thomas J. Rozmus, Paoli, both of Pa.

[73] Assignee: The Siemon Company, Watertown, Conn.

[21] Appl. No.: 23,948

[22] Filed: Feb. 26, 1993

[51] Int. Cl.[5] ..... H01R 4/24

[52] U.S. Cl. ..... 439/404

[58] Field of Search ..... 439/389–425

[56] References Cited

U.S. PATENT DOCUMENTS

| | | | |
|---|---|---|---|
| 3,112,147 | 11/1963 | Pferd et al. . | |
| 3,444,506 | 5/1969 | Wedekind | 439/405 |
| 3,496,522 | 2/1970 | Ellis, Jr. et al. | 439/404 |
| 3,518,618 | 6/1970 | Swanson . | |
| 3,936,119 | 2/1976 | Ayer | 439/404 |
| 4,194,256 | 3/1980 | Knickerbocker . | |
| 4,468,079 | 8/1984 | Knickerbocker . | |
| 4,533,195 | 8/1985 | Knickerbocker . | |
| 4,585,290 | 4/1986 | Knickerbocker et al. . | |
| 4,670,851 | 6/1987 | Murakami et al. . | |
| 4,820,195 | 4/1989 | Siemon . | |
| 4,883,430 | 11/1989 | Siemon et al. . | |
| 4,924,345 | 5/1990 | Siemon et al. . | |
| 4,944,698 | 7/1990 | Siemon et al. . | |
| 4,964,812 | 10/1990 | Siemon et al. . | |
| 5,127,845 | 7/1992 | Ayer et al. . | |

*Primary Examiner*—Joseph H. McGlynn

*Attorney, Agent, or Firm*—Fishman, Dionne & Cantor

[57] ABSTRACT

The present invention presents an improved clip and an improved block wherein the material requirements for the clip are reduced and transmission performance for the assembly is improved. The present invention also presents a method of manufacturing the improved clip. The clips are of the type generally referred to in the art as 66 type clips. The clip of this invention has an oval opening with parallel sides between the base and that portion of the clip which holds the wire; and the oval aperture is flanked by arm portions of diverging width from the top of the aperture to the bottom of the aperture. In other words, the sides of the arms adjacent to the aperture are parallel, and the sides of the arms remote from the aperture diverge outwardly. This makes the arms thicker in width as they approach and join the base. This construction achieves the important advantage of a tapered beam element, which is well known to result in superior stress distribution than beams whose thickness is uniform. The design of the tapered arm portions of the present invention thereby produces equal or slightly higher normal forces than the prior art 66 clips with approximately 25 percent less material. Also, when displaced by a terminated wire, the clip of the present invention provides higher normal force than the prior art clip described in U.S. Pat. No. 5,127,845, which has greater material content.

32 Claims, 10 Drawing Sheets

5.473LB. .021 DEFLECTION, .31 FROM TOP
500 CLIP ANALYSIS .0425 MATERIAL 4.92/4.62 LB. .021 DEFLECTION, .31 FROM TOP
RELIANCE CLIP ANALYSIS 5.437 LB. .021 DEFLECTION, .31 FROM TOP
MODIFIED 500 CLIP .285 SLOT CH'G'D. TO .275: .07 CH'G'D. TO .08

MATERIAL REDUCED, TRANSMISSION ENHANCED CONNECTING BLOCK AND CLIP AND METHOD OF MANUFACTURE THEREOF

BACKGROUND OF THE INVENTION

This invention relates to the field of terminal clips and blocks, and connecting block assemblies thereof, used in telephone and data transmission interconnect assemblies. More particularly, this invention relates to a material reduced and transmission enhanced clip and block for clips of the type generally referred to in the art as 66 type clips. This invention also relates to a novel method of manufacturing such terminal clips.

Clip and block assemblies for 66 type clips are well known in the art and have been in use for many years. See, e.g., U.S. Pat. Nos. 3,112,147 and 3,518,618 to Pferd et al and to Swanson et al, respectively. These assemblies include a dielectric block or housing in which are located an ordered array of terminal clips. The clips are located in a series of openings in the block, and the top, or interconnect, end of each clip projects through the opening to extend above the upper surface of the central portion of the block. The bottom or base portion of each clip is retained within the body of the block by a combination of interaction with the block and a retainer plate which connects to the bottom of the block and retains the clips in position in the block.

Recently, a requirement has arisen for a small 66 type clip that will be both (a) less expensive, because of reduced volume of material present in the clip, and (b) suitable for and capable of functioning in and for the same applications for which the previous 66 type clips have been used.

One attempt at a smaller and less expensive 66 type clip, and a block therefore, is disclosed in U.S. Pat. No. 5,127,845 to Ayer et al. According to the '845 patent, the thickness of the clip is reduced relative to a previous 66 type clip of U.S. Pat. No. 3,112,147, the upper portion of the clip is unchanged in configuration relative to that previous clip, and the base is reduced in size relative to that previous clip, so that the overall height of the clip is about three-fourths that of the previous clip and the clip requires about two thirds of the material of that previous clip. The '845 patent is the closest prior art to this invention known to the inventors of the subject matter of this application.

An important feature of the Ayer et al '845 patent is that the lower part of the clip has a downwardly divergent aperture (76) between the base and that portion of the clip which holds the wire, and that aperture is flanked by arm portions (78,80) of constant width. The aperture (76) is triangular in shape, and the opposed inner and outer surfaces of the arm portions (78 and 80) are parallel.

As with prior art patents, most notably the Swanson '618 patent, the terminal block assembly described by the Ayer et al '845 patent consists of a block body that positions clips at a constant spacing and a slidably engageable retaining plate designed to captivate the clips in said block body. An important limitation of these and other prior art patents is that the regular clip spacing causes uniform capacitive coupling between adjacent rows of clips such that, when used with twisted-pair wires, the capacitive coupling between "tip" and "ring" wires that constitute a pair is equal to that of adjacent conductors from different pairs. Since crosstalk performance is determined by the capacitive imbalance between pairs (i.e., the difference in capacitive coupling between each conductor of a pair and a conductor of another pair), the constant spacing between rows poses a limitation in terms of crosstalk performance between adjacent circuits.

While it is appreciated that crosstalk performance may be improved by simply increasing the constant spatial separation between rows, such an approach has limitations and trade-offs in terms of diminished insertion loss and return loss performance caused by increased separation between tip and ring conductors of a pair, as well as limited compatibility with tools, adapters and other devices designed to plug directly into selected groups of clips on the connecting block assembly. Examples of such tools and plug-on devices are disclosed in U.S. Pat. Nos. 4,194,256, 4,585,290, 4,820,195, 4,883,430, 4,924,345 and 4,944,698, all of which are assigned to the assignee hereof.

All prior art blocks of this type are also limited by their height and the amount of material used to manufacture the connecting block body. The heights of the Pferd and Swanson blocks are determined by the height of the clip whereas the height of the Ayer et al block is determined by the combined height of the clip and that of the retainer ribs that support the clips. The disadvantage of these designs is that they are more limiting than other popular connecting block designs, such as the well known 110-series blocks disclosed in U.S. Pat. No. 4,964,812 (also assigned to the assignee hereof), in terms of the vertical clearance required for the block assembly when it is installed in telecommunications cabinets or other shallow telecommunications distribution facilities. The relatively greater height of the prior art block designs also requires more plastic material, which poses other limitations in terms of manufacturing cost and shipping weight.

SUMMARY OF THE INVENTION

The present invention presents an improved terminal clip and an improved block wherein the material requirements for the clip are reduced and transmission performance for the assembly is improved. This invention also relates to a novel method of manufacturing such terminal clips.

In accordance with the present invention, both the thickness of the clip and the overall height of the clip are reduced to achieve a clip that has about 35% less material (preferably copper alloy) and has about 23% less height compared to 66 type clips currently made and sold by The Siemon Company (hereinafter the prior Siemon clip), assignee of this invention. All of the reduction in the height of the clip is achieved in the base and other portions of the clip that are below the surface of the block through which the clip projects. Thus, the part of the clip projecting above the surface of the block presents the same height and profile as the prior Siemon clip. As a result, the improved terminal clip of this invention is compatible with the same installation tools and adapters that are presently used with the prior Siemon terminal clip and block.

As distinguished from the clip of the Ayer '845 patent, the clip of this invention has an oval opening with parallel sides between the base and that portion of the clip which holds the wire; and the oval aperture is flanked by arm portions of diverging width from the top of the aperture to the bottom of the aperture. In other words, the sides of the arms adjacent to the aperture are parallel, and the sides of the arms remote from the aperture diverge outwardly. This makes the arms thicker in width as they approach and join the base. This construction achieves the important advantage of a tapered beam element, which is well known to result in superior stress distribution than beams whose thickness is uniform (i.e., parallel arm portions as taught by the Ayer '845 patent). The design of the tapered arm portions of the present invention thereby produces equal or slightly higher normal forces than the prior art Siemon 66 clip with approximately 25 percent less material. Also, when displaced by a terminated wire, the clip of the present invention provides higher normal force than the prior art Ayer '845 clip, which has greater material content.

The present invention also includes a block in which the clips are mounted. In accordance with the present invention, the clip and block assembly achieves improved transmission characteristics by virtue of the fact that the clips used to connect tip and ring conductors of each twisted-pair circuit are spaced closer than adjacent conductors of separate pairs by at least 10 percent. This new spatial arrangement is achieved while preserving the same center-to-center distance between pairs of prior art connecting blocks of the same type. The advantage of preserving the center spacing between pairs (rather than between clips) is that it allows the block assembly to maintain compatibility with the plug-on accessories referenced hereinbefore.

This increased spatial separation between clips used for adjacent pairs will have the effect of improving crosstalk performance of the connecting block. Also, the decreased spatial separation between clips used for tip and ring conductors within a pair acts to minimize the impedance discontinuity between the twisted-pair cable and connecting block. This closer spacing therefore produces the beneficial result of minimizing signal reflections which are also expressed in terms of return loss. Since there is less reflected energy, insertion loss performance is also improved. The combination of these effects results in a significant overall improvement in the transmission performance of the connecting block assembly when it is used for data circuits with transmission rates up to 100 megabits per second or higher.

As distinguished from the block of the Ayer '845 patent, the retaining plate of the block of this invention is a relatively thin plate with a flat inner surface which is flush with the bottom surfaces of clips mounted in the body of the block. The block of the present invention is therefore free to use the same retainer as that used in the original S66M1-50 block sold by The Siemon Company. This retainer construction is substantially the same as that disclosed in the Swanson '618 patent and thus the height of the block assembly of this invention is less than that of all prior art assemblies of the well known 66-type. This reduction in height of approximately 20 percent has the advantage of being able to fit in locations where low profile mounting is needed and is achieved without sacrificing compatibility with a retainer design that has been in use in the industry for over two decades. The height reduction also carries with it a material volume reduction of 25 to 30 percent over prior art block bodies with the same length, width and mounting features.

The use of the standard retainer carries with it the benefits of lower tooling costs for the completed assembly and, more significantly, ensures that the block of the present invention is compatible with standard mounting hardware, brackets and hole patterns since all known mounting means are designed to attach to the retainer which, in turn, captivates the clips and secures the block body in a fixed position.

In accordance with the method of the present invention, the terminal clip is manufactured using a novel stamping and forming process. In prior art processes for manufacturing terminal clips of the type described herein, the clip shape is stamped out in essentially its finished configuration. The stamped clip is then lanced to split the clip and form the insulation displacement slit. This splitting introduces a step intersection at the functional entrance of the clip which causes an undesirable burr. In order to plate the finished clip, a coining operation is required to open the split.

In contrast to the prior art manufacturing method, in accordance with the present invention, the clips are initially stamped in an open configuration and then the clips are closed to a final, finished configuration. This enables the clips to be manufactured without splitting, i.e., no steps or burrs. It also enables the introduction of an air gap bump which is formed as part of the original punch configuration. This air gap bump eliminates the air gap variation caused by material thickness variation and insures a uniform air gap. This air gap is needed for subsequent plating operations. The air gap bump also eliminates the coining adjustment. Since these clips are typically manufactured in multiples, the air gap bumps ensure a uniform air gap. The closing of the clips can be done in many ways. For example, the clips may be closed with wedge shaped punches. Significantly, the number of punches used in the method of this invention compared to the prior art process is halved. This will result in substantially reduced manufacturing costs and better uniformity.

In accordance with another important feature of this invention, a coining operating is used on the outer edges of the lowermost portion of each arm to provide a preload to each terminal clip.

BRIEF DESCRIPTION OF THE DRAWINGS

Referring now to the drawings, wherein like elements are numbered alike in the several FIGURES:

FIGS. 1A–D are views of the clip and block assembly in accordance with the present invention wherein FIG. 1A is a top plan view thereof, FIG. 1B is a side elevational view thereof, FIG. 1C is an end elevational view thereof and FIG. 1D is a cross-sectional view taken along line 1D—1D of FIG. 1A.

FIGS. 2A–B are views of the block body used in the assembly of FIG. 1 wherein FIG. 2A is a rear plan view thereof and FIG. 2B is a view taken along line 2B—2B of FIG. 2A.

FIGS. 4A–C are views showing stress contours of three 66-type clip configurations that are each displaced in a manner that is consistent with the termination of a 22 AWG solid wire wherein FIG. 4A shows a prior art 66-type clip of the type disclosed in the Pferd '147 patent, FIG. 4B shows a 66-type clip of the type disclosed in the Ayer '845 patent and FIG. 4C shows a 66-type clip of the type shown in FIG. 3 in accordance with the present invention.

DESCRIPTION OF THE PREFERRED EMBODIMENT

Figure 1A:
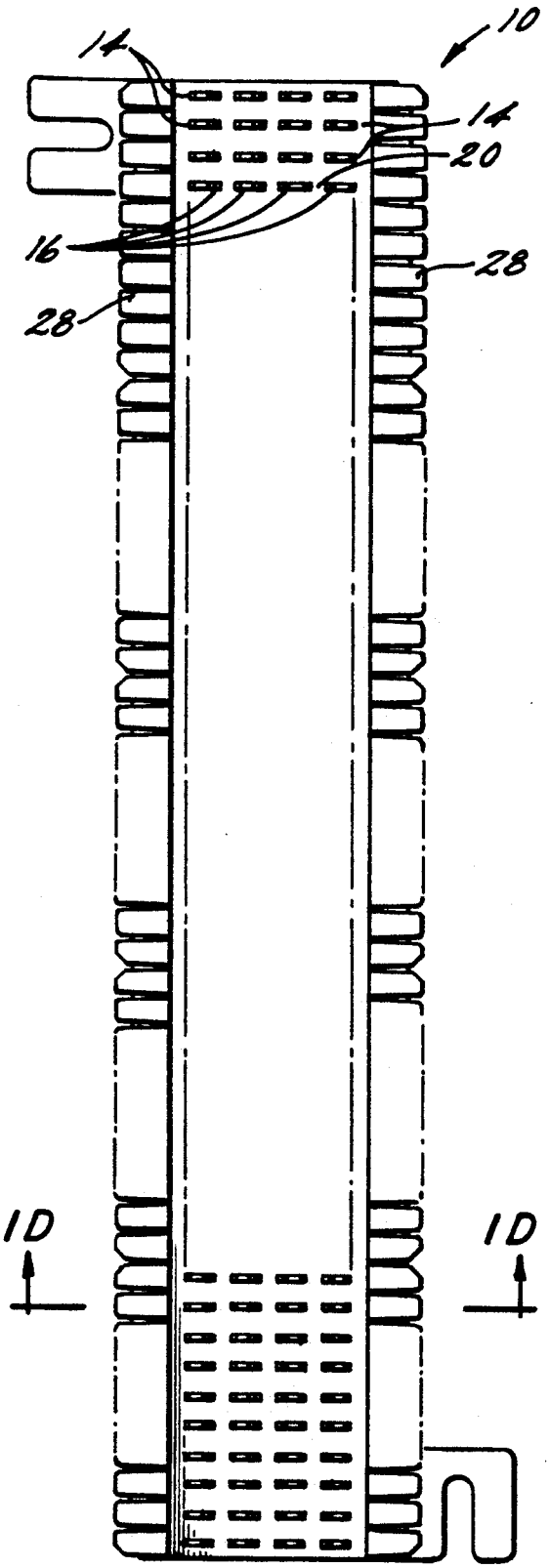
Figure 1B:
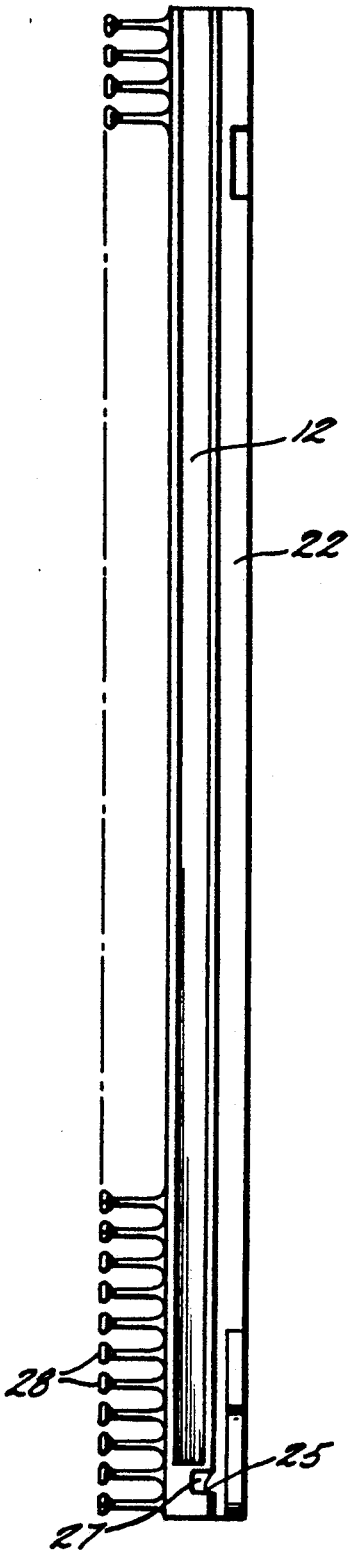
Figure 1C:
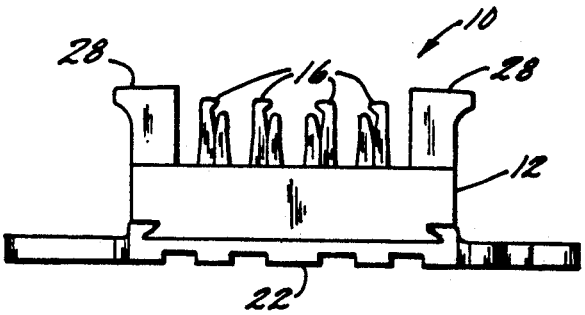

FIG. 1 shows a block and clip assembly 10 in accordance with the present invention. The assembly includes a block body 12 with an ordered array of openings 14. The rear surface of block body 12 is shown in FIG. 2A and the cross-sectional configuration of block body 12 is shown in FIG. 2B. In the configuration shown, the array is of four columns with 50 openings per row, although those numbers may vary for other designs. Terminal clips 16 are located in each of the openings 14. In the embodiment shown in FIGS. 1 and 3, each terminal clip 16 is a two pronged clip; that is, there are two independent wire receiving sections extending from a common base 18. It will, however, be understood that the terminal clip may be a single prong unit, or it may have more than two prongs. Also, the terminal clip may, if desired, have a tail depending from base 18 for wire wrapping, printed circuit board connection or plug-on adapters. The terminals 16 are loaded into the block 12 from the bottom to loosely engage downwardly depending body segments 20. The terminals are held in place in the block by a retaining plate 22 which has V shaped projections 24 for engagement with complimentary V shaped grooves on body 12. Retaining plate 22 slides into position relative to the length of block body 12 until notches in the retainer abut on the two extending tongues 21 at the far end of the block body; and is retained in place relative to the block body by small snap projections 25 in the retainer which engage small recesses 27 in the body in a well known manner. The inner surface 26 of retaining plate 22, i.e., the surface facing the bottoms of terminal bases 18, is flat and directly engages the entire lower surface of each base 18. The block also has fanning strips 28 for receiving wires from a cable in a well known manner and distributing the wires to the terminal clips across the face of the block.

The details of retainer plate 22, the means of securing it to block body 12, and the design of the fanning strips 28 are more fully disclosed in the Swanson '618 patent which has been incorporated herein by reference. Accordingly, the features illustrated in this embodiment are included by way of example only and do not limit the invention in any way.

Figure 1D:
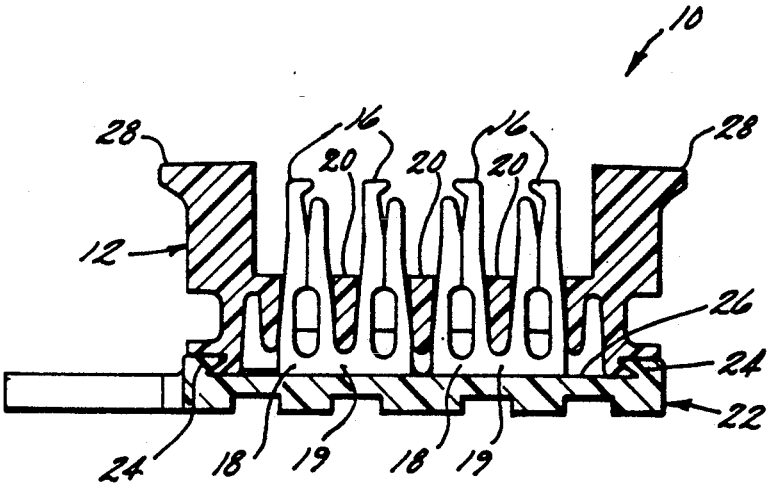
Figure 2A:
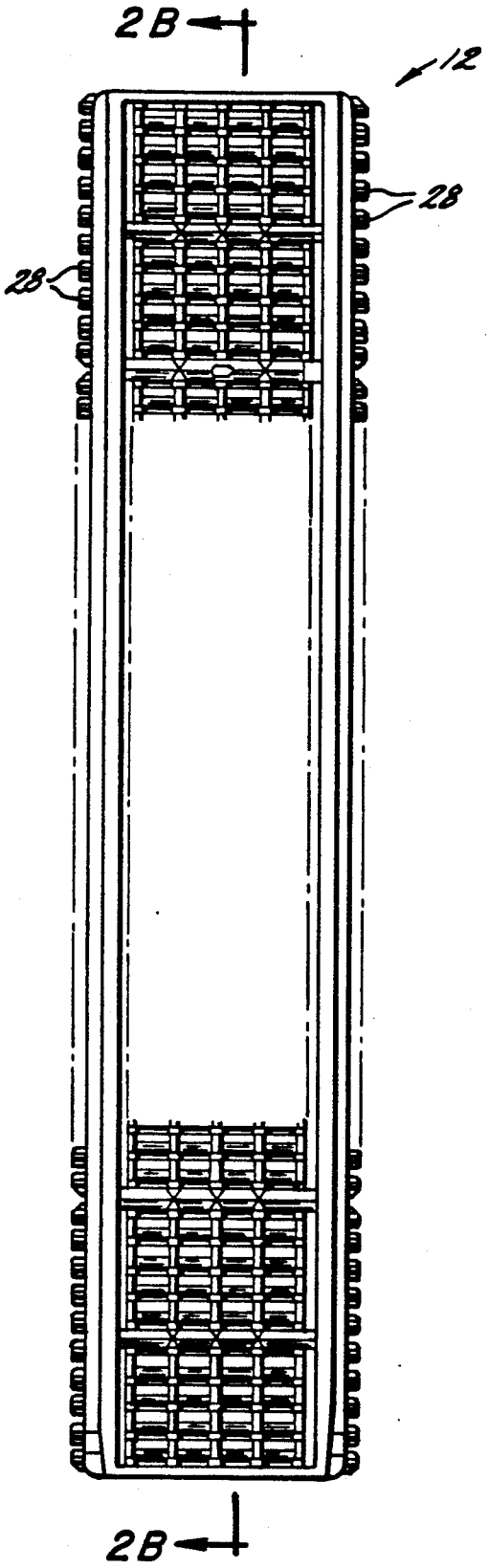
Figure 2B:
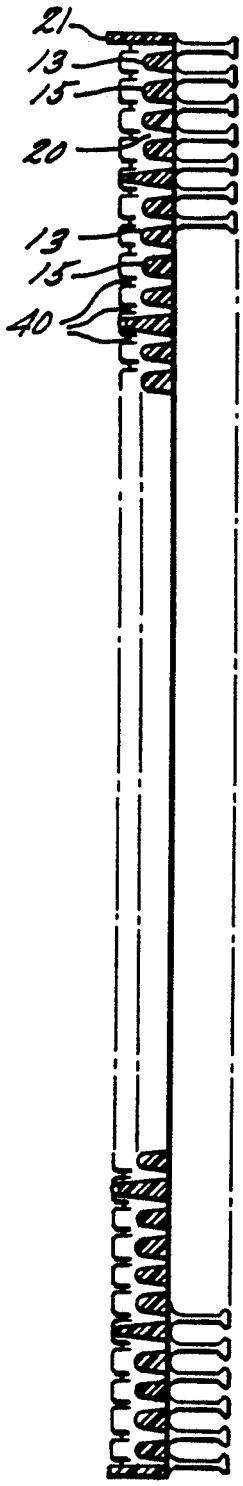

Referring to FIG. 1D, wherein a partially cross-sectioned view of the block assembly is shown, two rows of clips 16 are oriented 180 degrees with respect to each other and are dropped into block body 12 from the rear such that they protrude through openings 14 on the front surface of the block body. For the embodiment shown, the center of clip base 18 has a web portion 19 that physically and electrically connects adjacent wire receiving sections. During and after assembly, the web portion 19 of base 18 is located in notches 40 that are spaced along ribs 20 such that they are laterally aligned with openings 14 through which the clips protrude. Once all of the clips are located in their respective positions, the retainer is slidably engaged with the block body until it is snapped into place as described above. This method of locating and securing the clips in place is presently used for prior art block assemblies and is illustrated by way of example only. Other construction methods (not shown), such as those that employ screws or other fasteners as a means of securing the retainer to the block body, and those that employ a unitary block body without a separate retainer plate, as disclosed in Knickerbocker U.S. Pat. Nos. 4,468,079 and 4,533,195, both of which are assigned to the assignee hereof, are also possible. Such designs allow the clip to be loaded from the top and have alternate means for locating and securing the clips to the block body. It will be appreciated that such alternate embodiments may also be used without departing from the spirit of the invention.

Figure 3:
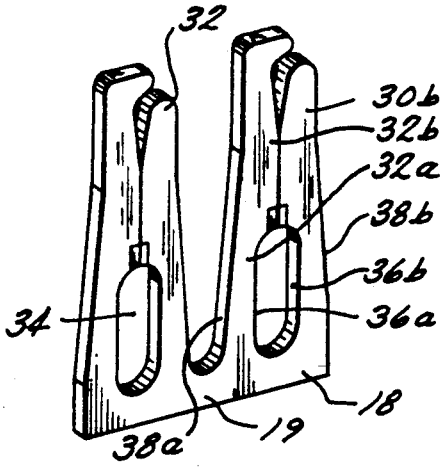
FIG. 3 is an enlarged isometric view of the clip of FIG. 1.

Referring particularly to FIG. 3, and as indicated previously, the two pronged terminal clip of this invention is reduced in material relative to the prior clip disclosed in the Pferd '147 patent and sold by Siemon. The width of the clip across base 18 is approximately 0.54", the overall height from the base to the top of the clip is approximately 0.78", and the thickness of the clip is 0.044" and the clip weighs 1.4 grams. Those dimensions compare to a width of 0.58", a height of 1.01", a thickness of 0.044" and a weight of 2.2 grams for the prior Siemon clip. Each prong or connecting unit of the terminal clip has a pair of opposed arms 30 and 32 extending upwardly from base 18. Arm 30 has a lower section **30*a* and an upper section 30*b*; and arm 32 has a lower section 32*a* and an upper section 32*b*. The upper arm sections 30*b* and 32*b* form the wire retension section of the clip. An insulated wire, typically of gage 22 to 26, is inserted and held in position between the opposed inner or facing surfaces of arm sections 30*b* and 32*b*. The wire is inserted in usual fashion by a wire insertion tool. The clip is of the insulation displacement type, whereby insulation surrounding the wire is removed by interaction with the clip and tool in the course of inserting the wire into the clip. The wire is inserted into the terminal clip at the enlarged opening between arms 30, 32** at the top of the clip, and the wire is pushed into place and located a distance of between 0.31" to 0.37" below the uppermost surface of the clip.

An oval aperture 34 extends from base 18 along lower arm segments **30*a*, 32*a* to the lower part of upper arm segments 30*b*, 32*b*. The sides 36*a* and 36*b* of this oval aperture, which are the inner facing side surfaces of lower arm segments 30*a*, 32*a*, respectively, are parallel, whereas the outer side surfaces 38*a*, 38*b* of lower arm segments 30*a*, 32*a* are divergent. That is, moving in the direction from the top of the clip toward the base 18, the outer side surfaces 38*a*, 38*b* of arm segments 30*a*, 30*b* are angled outwardly at an angle of approximately 4.5 degrees relative to parallel surfaces 36*a*, 36*b*. The result of this construction is that the width of lower arm sections 30*a* and 30*b* increases in the direction approaching the base 18 to a maximum width where the arms are connected to base 18. This tapered beam construction of arms 30*a* and 30*b* has the important effects of distributing stress along the length of arm segments 30*a*, 32*a*** in a more even, uniform manner than arm segments with parallel sides such as described in the '845 patent to Ayer et al.

In a preferred embodiment, the length of each lower arm section **30*a* and 30*b* is about 0.19 inch between the upper and lower bend radii. The width of clip 16 is about 0.07 inches at the lower portion of beams 30*a* and 32*a* base and is about 0.055 inches at the upper portion of beams 30*a* and 32*a***.

Figure 4A:
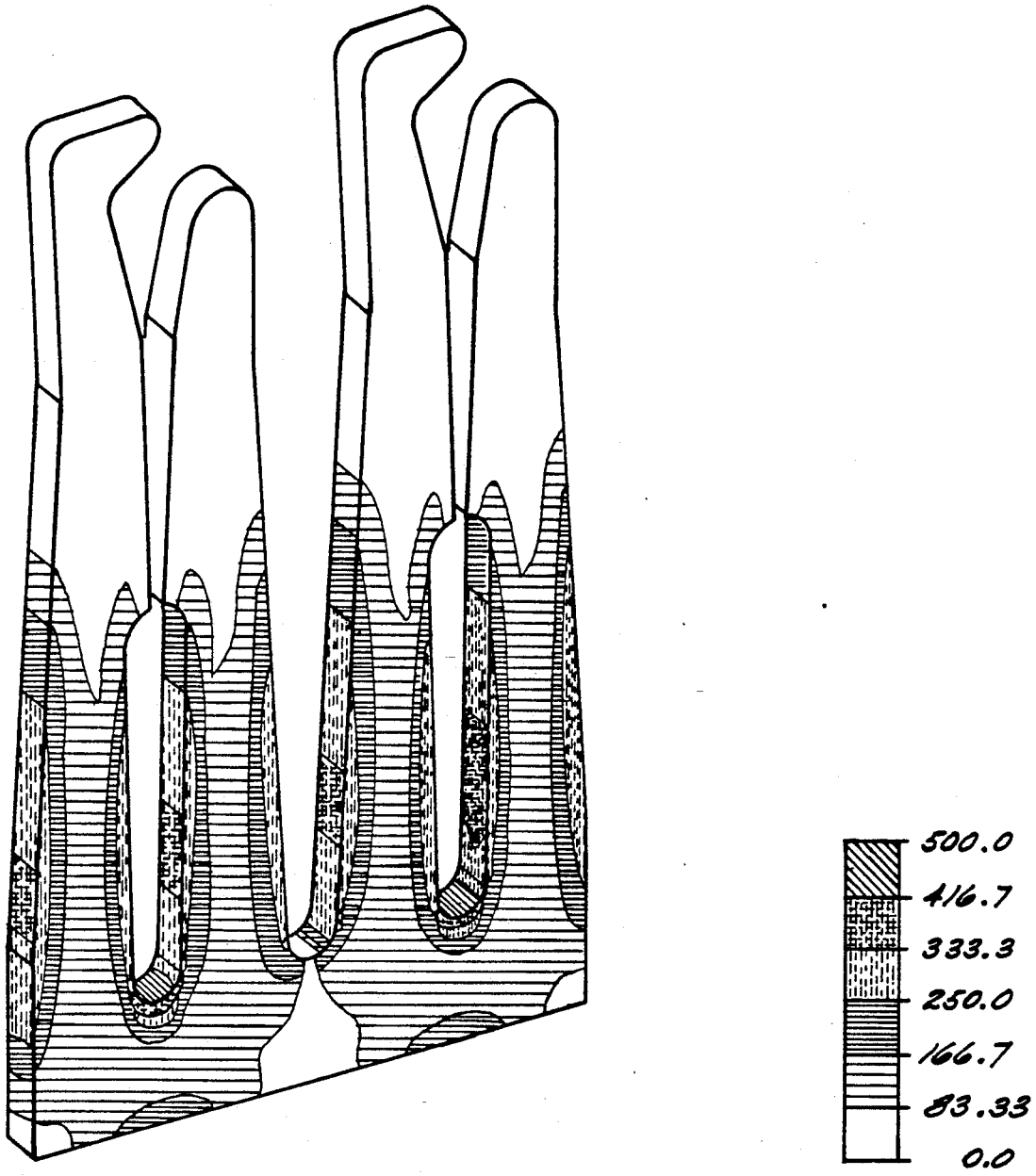
Figure 4B:
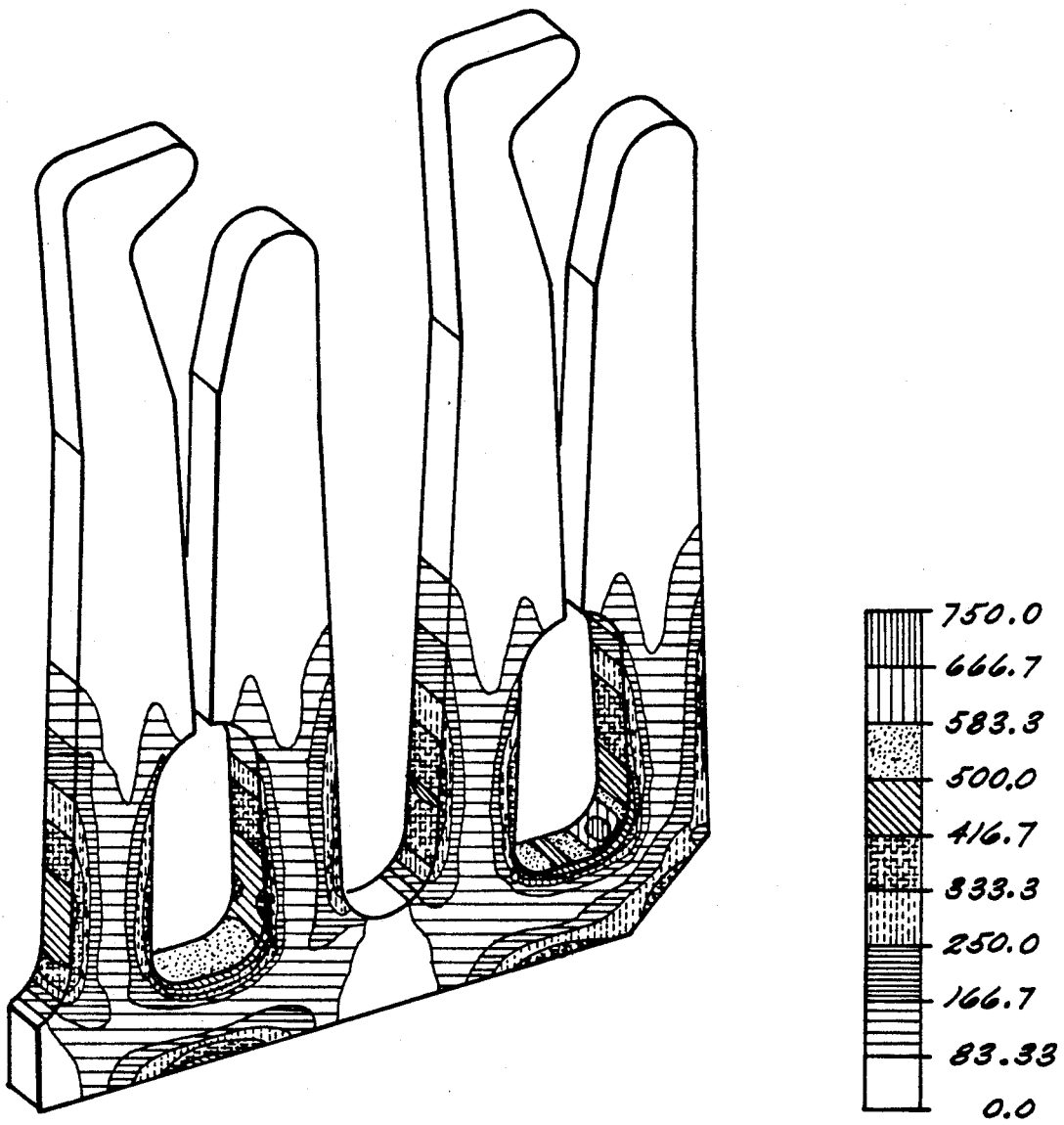
Figure 4C:
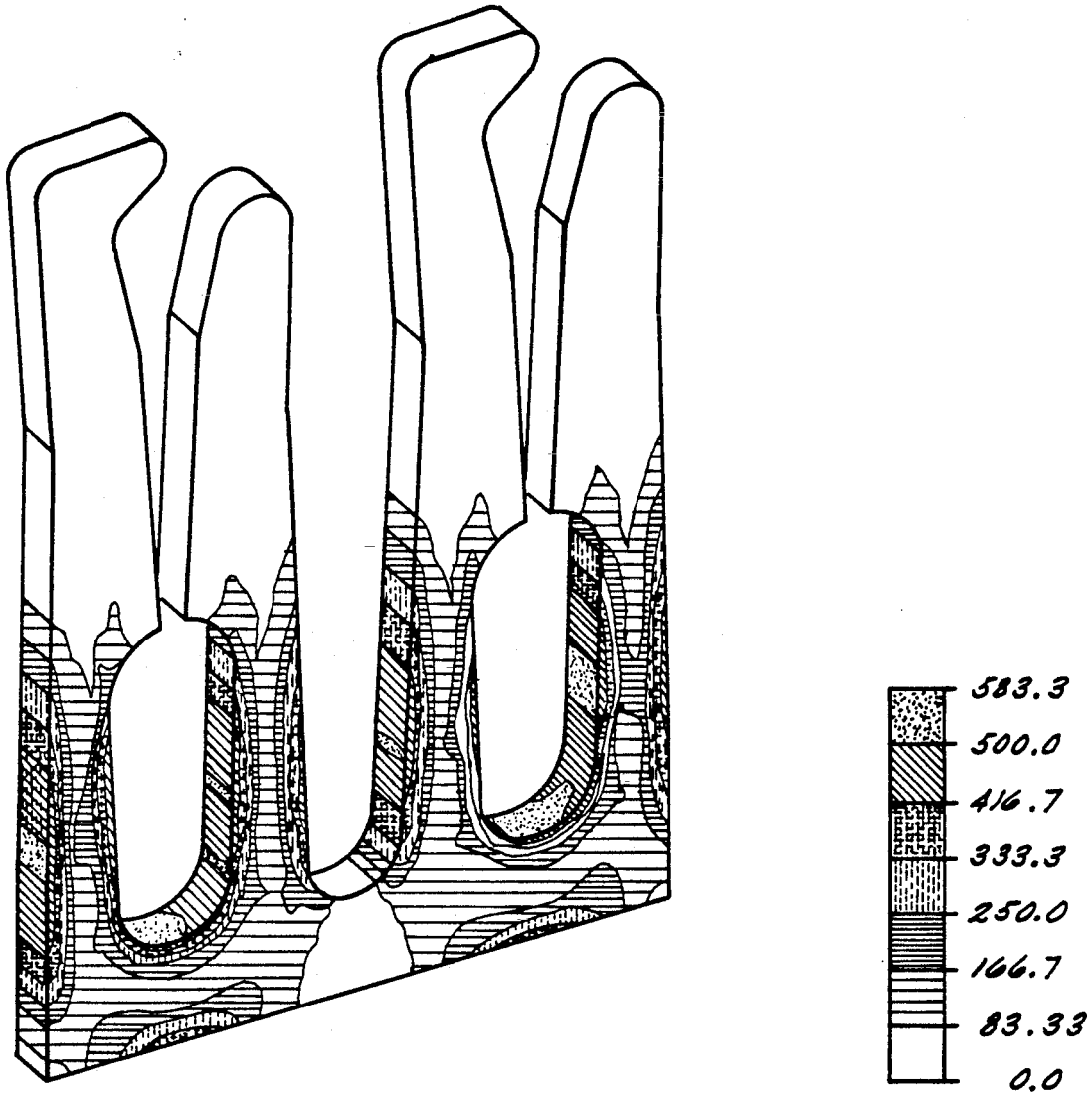

By way of illustration, FIGS. 4A–C show stress contours for three clip designs with the same material thickness that are subject to substantially the same elastic deformation as that which has been observed to be caused by the termination of a 22 AWG solid wire. That is, the arm segments are spread a total distance 0.021 inches apart, at a distance of 0.31 inches from the top of the clip and in such a way that the two beams remain in an equilibrium condition (i.e., the resulting reaction forces of the complementary beams are equal and opposite). By subjecting the three clip designs to the same degree of physical deformation as that caused by the terminated wire, it is possible to examine the resulting stress distribution within the contact and to compare maximum stress and the reaction forces (also known as contact normal forces) that determine the long-term electrical integrity of the clip-to-wire connection.

FIG. 4A depicts the stress contour of the Pferd '147 patent clip design (corresponding to the prior Siemon clip). As with the present invention, this prior clip design features tapered beam arm segments that exhibit a relatively low maximum beam stress of approximately 42,000 PSI and a maximum base stress of approximately 50,000 PSI for this deflection case. The limitation of this prior clip design is that it requires significantly more material to generate a reaction force of 5.4 pounds on the terminated wire, which is comparable to the designs shown in FIGS. 4B and 4C. It will be appreciated that materials used for the fabrication of these clips, namely high strength copper alloys such as UNS Number C51000 phosphor bronze, are capable of flexural yield strengths of greater than 100,000 PSI. Since it is not uncommon to design for maximum stress of up to 80 percent of the material's flexural strength, it will also be appreciated that the prior clip design of FIG. 4A does not fully utilize the material's flexural strength capability.

FIG. 4B depicts the stress contour of the Ayer et al '845 patent clip design that is presently manufactured by the assignee of the '845 patent. This clip design features parallel beam arm segments that exhibit a maximum beam stress of approximately 50,000 PSI and a maximum base stress of approximately 58,000 PSI for this deflection case (not including the considerably higher stress in the angularly notched, lower right corner of the clip). For this design, the termination position on the left exhibits a reaction force of 4.9 pounds (slightly lower than the clip of FIG. 4A, but sufficient to achieve a stable electrical connection with the terminated wire).

FIG. 4C depicts the stress contour of the present invention clip design. This clip design features tapered beam arm segments that exhibit a maximum beam stress of approximately 54,000 PSI and a maximum base stress of approximately 54,000 PSI for this load case. The fact that the maximum beam stress and the maximum base stress are balanced is significant because stress is more evenly distributed throughout the clip of the Present invention than either of the two prior art designs. The clip of FIG. 4C exhibits a reaction force of 5.4 pounds which is at least equal to the clip design of FIG. 4A with approximately 34 percent less material. It is also significant that the tapered beam construction of the present invention provides greater connection pressure and exhibits an improved stress distribution than the straight beam clip design of FIG. 4B. These advantages over the FIG. 4B clip design are achieved with equal or less material volume.

An additional benefit of the reduced material requirements of the present clip design is reduced surface area. Not only does reduced surface area result in lower plating costs, but it also reduces capacitive coupling between vertically adjacent clip positions in the block assembly. Since the facing surfaces of clip 16 effectively represent parallel plates and since the block body and air that surrounds them are best described as having dielectric properties, the parallel clips contain all of the elements of a capacitor whose value depends on the surface area of the facing plates, their distance apart, and on the Properties of the dielectric material(s) between them. It will be appreciated that the block of the present invention is intended for connection to telecommunications circuits, and that such telecommunications circuits may include applications whose transmission rates are as high or higher than 100 Megabits per second.

Connector performance is characterized using the parameters of attenuation, near-end crosstalk (NEXT) and return loss. Explanations of these parameters and how they affect transmission performance are more fully described in U.S. Pat. application Ser. No. 993,480 filed Dec. 18, 1992, assigned to the assignee hereof and fully incorporated herein by reference. Generally, in order to optimize connector performance, the magnitude of attenuation (also known as insertion loss) should be as low as possible and the magnitudes of NEXT and return loss should be as high as possible throughout the frequency range of interest (in this case, from 1 to 100 Megahertz). Due to their short electrical length, relative to the wavelength of the transmitted signal, the effects of connector attenuation and return loss on end-to-end transmission line performance are not as significant as the parameter of NEXT, which can degrade signal-to-noise margins of twisted-pair cabling by more than 12 decibels (this degradation is equivalent to an increase in noise voltage of 4-fold). Therefore it is desirable to optimize the performance of all parameters, with particular emphasis on near-end crosstalk.

In the design of connecting hardware for balanced transmission lines such as twisted-pair cables, it is desirable to maintain some degree of electrical coupling between the tip and ring conductors of a pair in order to preserve balance and field cancellation between equal and opposite signals on the tip and ring conductors. Likewise, it is preferable to maintain a degree of electrical isolation between pairs to minimize capacitive imbalance such that NEXT performance is optimized.

Referring back to FIG. 1A, 2A and 2B, an important feature of the block body is that recessed cavities 14 that are used to position clips 16 are spaced in staggered groupings such that the first two openings (that correspond to the two conductors of a twisted-pair circuit) have closer vertical spacing than the second and third openings (that correspond to two conductors from adjacent twisted-pair circuits) and the third and fourth openings have closer vertical spacing than the fourth and fifth openings and so on. Therefore, cavities 14 are separated by ribs 13, 15 (see FIG. 2B) of alternating thicknesses in order to reduce the separation between tip and ring conductors of a twisted-pair circuit and to increase the separation between pairs. For this embodiment, the center spacing between openings is made to alternate between 0.188" and 0.212" such that the center spacing between pairs is maintained at 0.40". This overall spacing between pairs is the same as the blocks of Swanson and the Ayer patent and offers the benefit of maintaining compatibility with tools, accessories and assembly equipment that were expressly designed for use with prior art blocks. This block body construction has the additional benefit of minimizing the separation of associated tip and ring conductors, thereby helping to preserve the balance and coherence of the twisted pairs.

Figure 5:
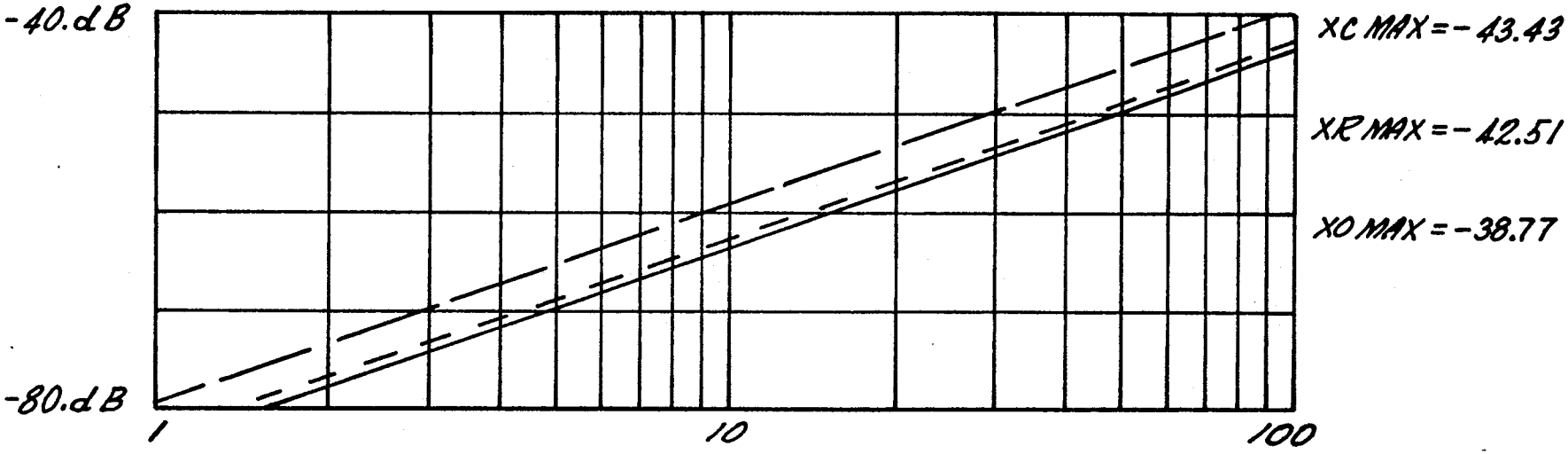
FIG. 5 depicts near-end crosstalk (NEXT) performance curves for the three 66-type clip and block configurations shown in FIGS. 4A, 4B and 4C.

Attenuation tests performed on the three block assemblies described above reveal an extremely small difference of less than 0.02 dB throughout the entire frequency range from 1 to 100 MHz Return loss measurements of the three block types show that they easily surpass the most severe industry requirements for this parameter by a margin of at least 10 decibels. An illustration of the prime performance benefit that is offered by the block of the present invention is depicted in FIG. 5, which shows worst-case NEXT performance curves for three 66-type clip and block designs in the frequency range of 1 to 100 Megahertz based on a minimum of ten production samples for each type. The short dashed curves 40 represent the 66 block of the type disclosed in the Swanson '618 patent and manufactured by the assignee hereof, the long dashed curves 42 represent the 66 block of the type disclosed in the Ayer '845 patent and manufactured by the assignee thereof and the solid curves 44 represent the 66 block of the type disclosed in the present invention. These curves show that, of the three blocks tested, the block of the present invention exhibits consistently superior NEXT performance by a margin of 1 to 5 dB. This difference translates directly into transmission benefits in terms of signal to noise ratio for operating telecommunications networks and is a direct product of the reduced clip area and of the improved spacing offered by the present invention.

It is also appreciated that, by using block body materials with low dielectric constant and dissipation factors, it is possible to further improve transmission performance of all three connecting blocks of the types tested in FIG. 5.

Figure 6:
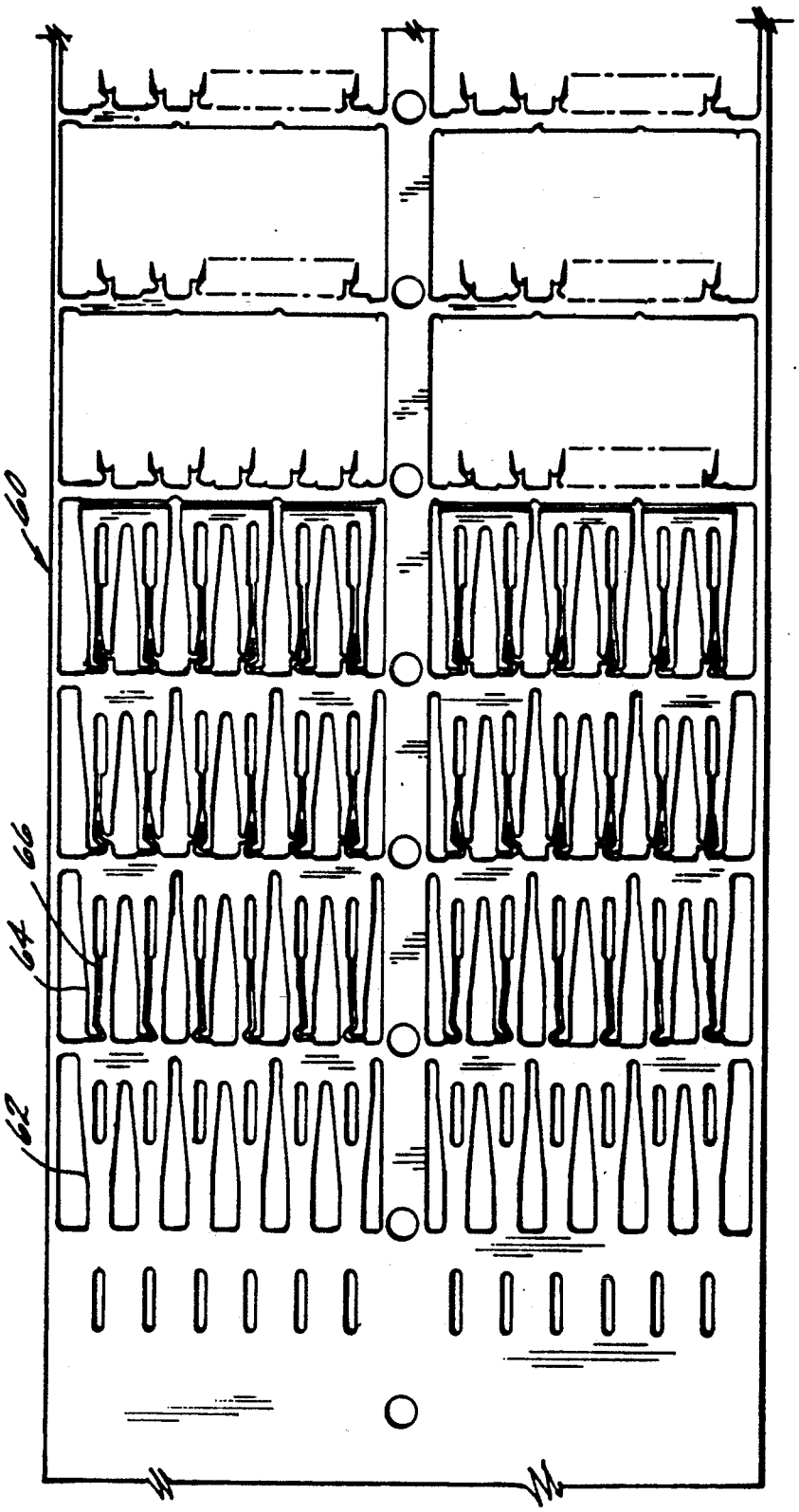
FIG. 6 (PRIOR ART)
FIG. 6 is a plan view of a process for stamping terminal clips in accordance with the prior art.

The present invention also relates to a novel method of manufacturing terminal clips of the type depicted in FIG. 3. Prior to describing this novel method however, reference is made to FIG. 6 which depicts a prior method of manufacturing insulation displacement contact clips used extensively in telephone wiring systems and generally known as 66-type clips. Typically, the prior art has utilized a progressive dye to manufacture the copper alloy clips. FIG. 6 depicts a strip 60 progression showing the typical and well-known prior art process of manufacturing 66-type clips using a progressive dye. It will be appreciated that strip 60 exhibits terminal clips 62 which have been stamped out in essentially their finished configuration. Thereafter, as shown at 64, the clips are lanced (typically twice) to "split" the clip and define the insulation displacement slit 66. As is well known, this splitting action introduces a step intersection at the functional entrance of the clip which causes an undesirable burr to form. In order to plate the finished clips, it is therefore necessary to coin open the split which provides an additional and undesirable variable in the manufacturing process.

Figure 7:
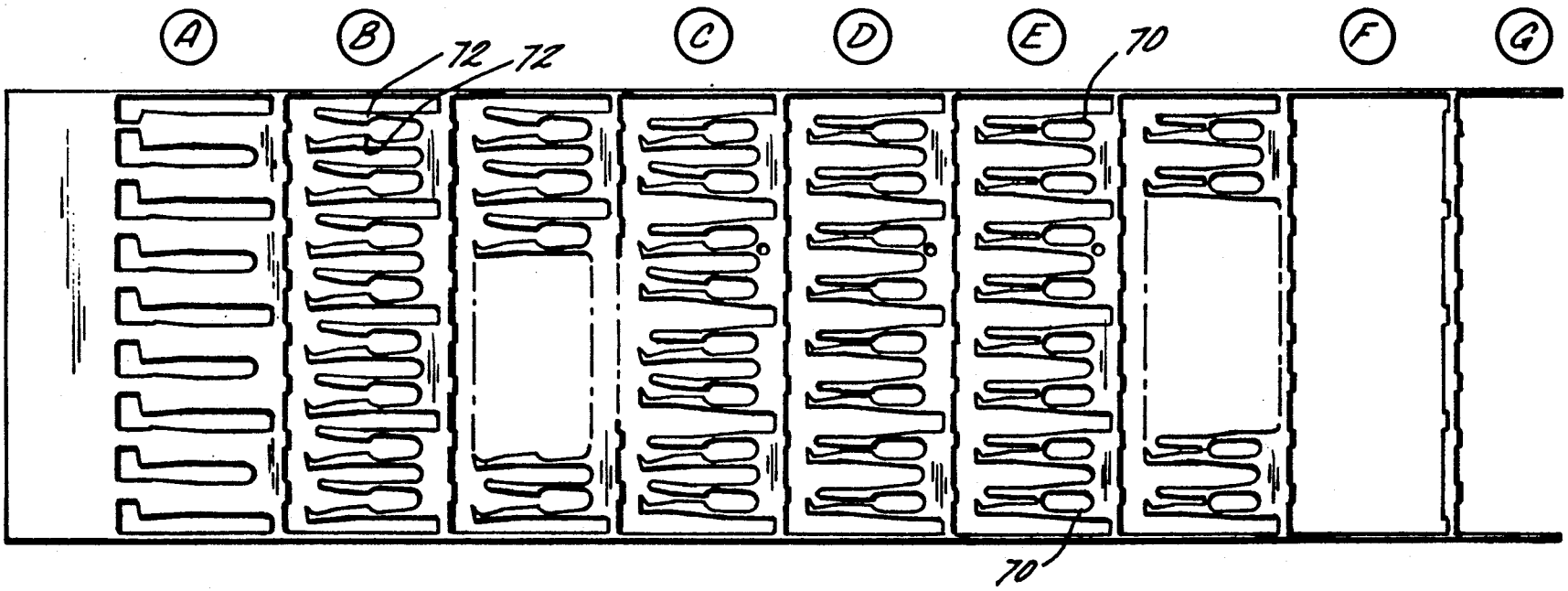
FIG. 7 is a plan view of a process for stamping terminal clips in accordance with the present invention.

Turning now to FIG. 7, a strip progression depicting the manufacture of clips 16 of the present invention is shown. In accordance with the process of the present invention, the clips 16 are stamped in an open configuration and are then closed to define their finished configuration. It will be appreciated that this process of initially opening, followed by closing the clip, is the exact reverse of the prior art process wherein the clips are formed initially closed and are then opened. The novel process of the manufacturing method of the present invention enables the clips to be manufactured without splitting and therefore the clips of the present invention will not exhibit the undesirable steps or burrs associated with the prior art manufacturing process. In addition, the method of the present invention introduces an air gap bump (see FIG. 8) which is formed as a part of the original punch configuration. Significantly, this air gap bump eliminates the air gap variation caused by material thickness variation. This air gap bump also eliminates the coining adjustment required by the prior art method of FIG. 6. Since clips 16 are typically manufactured in multiples, the air gap bumps ensure a uniform air gap. It will be appreciated that the closing of the clips can be accomplished in a variety of methods. For example, in a preferred method, the clips are closed with wedge-shaped punches. In accordance with an important feature of this invention, the number of wedge-shaped punches necessary to close the clips in the novel FIG. 7 method of this invention is about 50 percent of the number of punches needed in the prior art process. This lower number of punches results in a substantially reduced manufacturing cost as well as better uniformity to reach clip 16.

Figure 8:
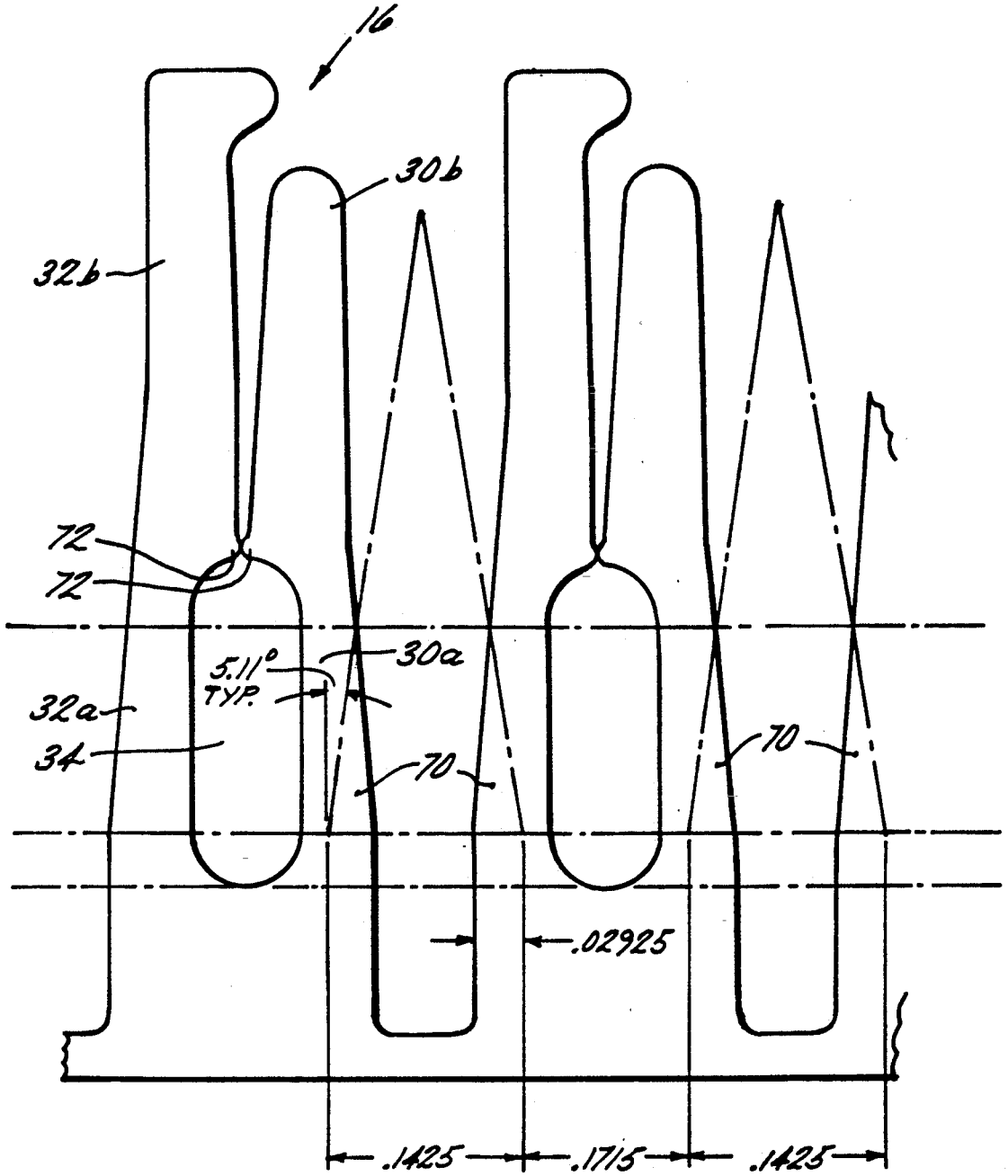
FIG. 8 is an enlarged plan view of a portion of FIG. 7 depicting an air gap bump.

Still referring to FIG. 7, the specific manufacturing method of the present invention will now be discussed with reference to the punch stations identified by letters A–G. In punch stations A and B, the open shape of the clip is formed. Punch stations C and D are the closing stations. It will be appreciated that the clip legs are not closed in pairs. This even/odd closing pattern prevents distortion of the clip legs during closing. While it is preferable not to close the clip legs in pairs, it will be appreciated that it is also possible to close them in pairs should that be desired. Punch station E incorporates a triangularly shaped preloaded coin which is formed by punching downwardly along the outer edges of the lowermost portions 30*a*, 32*a*, of each arm 30, 32 and is best shown in FIG. 8 at 70. Coin 70 generates increased normal force by allowing the beams to operate at a higher level on the stress/strain curve and acts to thrust the beams closed to Provide a preload. The preloaded coin has the additional advantage of increasing the moment of inertia of the clip leg which will tend to increase the normal force. Preferably, the clip is coined from both sides to minimize distortion. Punch station F constitutes the part cutoff station while punch station G is the scrap cutoff station.

It will be appreciated that the preloaded coin feature is an important feature of the method of the present invention as it increases the wire retension forces for improved performance. Thus, this preloaded coining provided during the manufacturing process will impart to the final clip 16 a preload that acts to increase the wire retension forces during use. Also, the technique for providing the triangularly shaped preload is applicable to any other flat terminal clip such as used in 110 blocks and the like.

FIGS. 7 and 8 also depict the small air gap bumps 72 formed during the initial stamping operation in facing relation on the inner surfaces of upper arm portions 30*b*, 32*b*, preferably directly above aperture 34.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A terminal clip comprising:

a flat body having a bas;

a pair of opposed resilient arms extending upwardly from said base, each of said arms having a lower section and an upper section, each of said lower sections having an inner side surface an an outer side surface, said inner side surfaces of said lower sections being in facing relation to each other, said upper sections of said opposed arms cooperating to define (1) a wire retention section of the clip and (2) a conductor receiving slot;

an aperture between said lower sections of said opposed arms, said aperture extending vertically between said base and said conductor receiving slot, said aperture having parallel side walls corresponding to said inner facing side surfaces of said lower sections of said opposed arms, said aperture having opposed first and second arcuate walls connecting opposed ends of said parallel side walls of said aperture, said first arcuate wall being positioned at the intersection between said lower section of said arms and said base and said second arcuate wall being positioned at the intersection between said lower and upper sections of said arms;

said outer side surfaces of each lower section diverging outwardly toward said base with respect to an inner side surface such that the width of each lower section increases in the direction approaching said base to a maximum width at the intersection between said lower sections and said base; and said loser section of each resilient arm having a length of about 0.19 inch, the width of said lower section just prior to said first arcuate wall being about 0.07 inch and the width of said lower section just prior to said second arcuate wall being about 0.055 inch.

2. The clip of claim 1 wherein:

said wire retension section comprises a notch.

3. The clip of claim 1 wherein:

each of said opposed arms exhibit substantially balanced beam and base stresses for evenly distributing stress throughout the clip.

4. The clip of claim 1 wherein said aperture has an oval shape.

5. The clip of claim 1 wherein:

said clip has a weight of about 1.4 grams.

6. The clip of claim 1 wherein:

said flat body has an overall height of about 0.78 inch.

7. The clip of claim 1 wherein:

said outer side surface of each lower section diverges at an angle of about 4.5 degrees relative to an inner side surface.

8. The clip of claim 7 wherein:

said stress distribution comprises, with respect to each of said opposed arms, a maximum beam stress of about 54,000 psi and a maximum base stress of about 54,000 psi.

9. The clip of claim 1 wherein:

said conductor receiving slot includes opposed air gap bumps extending toward each other from each arm.

10. The clip of claim 9 wherein:

outer edges of each lower section of each arm include a preload coin.

11. A terminal block assembly for mounting a plurality of terminal clips comprising:

a dielectric body having a central section and fanning strip sections at opposed margins of said central section, said central section having a plurality of side rows of openings, each of said openings comprising the entrance to a cavity, said cavity being defined by a pair of ribs;

a terminal clip received in each of said openings, said terminal clip including;

(a) a flat body having a base;

(b) a pair of opposed resilient arms extending upwardly from said base, each of said arms having a lower section and an upper section, each of said lower sections having an inner side surface and an outer side surface, said inner side surfaces of said lower sections being in facing relation to each other, said upper sections of said opposed arms cooperating to define (1) a wire retention section of the clip and (2) a conductor receiving slot;

(c) an aperture between said lower sections of said opposed arms, said aperture extending vertically between said base and said conductor receiving slot, said aperture having a parallel side walls corresponding to said inner facing side surfaces of said lower sections of said opposed arms, said aperture having opposed first and second arcuate walls connecting opposed ends of said parallel side walls of said aperture, said first arcuate wall being positioned at the intersection between said lower section of said arms and said base and said second arcuate wall being positioned at the intersection between said lower and upper sections of said arms;

(d) said outer side surfaces of each lower section diverging outwardly toward said base with respect to an inner side surface such that the width of each lower section increases in the direction approaching said base to a maximum width at the intersection between said lower sections and said base; and said lower section of each resilient arm having a length of about 0.19 inch, the width of said lower section just prior to said first arcuate wall being about 0.07 inch and the width of said lower section just prior to said second arcuate wall being about 0.055 inch.

12. The terminal block assembly of claim 11 wherein said openings are arranged in a matrix comprising a plurality of vertical columns of openings and a plurality of lateral rows of openings wherein two adjacent openings in a row define a pair and wherein:

said openings are spaced in staggered pair groupings such that with respect to five pairs of first, second, third, fourth and fifth openings consecutively adjacent to each other in a column, the pair of first and second openings have a closer vertical spacing relative to the second and third openings and the pair of third and fourth openings have a closer vertical spacing relative to the fourth and fifth openings whereby separation is reduced between tip and ring conductors of a pair of wires and separation is increased between respective pairs of wires terminated in said terminal clips.

13. The terminal block assembly of claim 11 wherein:

said ribs have alternating thicknesses in order to maintain said staggered groupings.

14. The terminal block assembly of claim 13 wherein:

the center spacing between openings alternates between about 0.188" and about 0.212" such that the center spacing between staggered pairs is maintained at about 0.40".

15. A terminal block assembly for mounting a plurality of terminal clips comprising:

a dielectric body having a central section and fanning strip sections at opposed margins of said central section, said central section having a plurality of openings in a matrix comprising a plurality of vertical columns of openings and a plurality of lateral rows of openings wherein two adjacent openings in a row define a pair, each of said openings comprising the entrance to a cavity, said cavity being defined by a pair of ribs, said openings being spaced in staggered pair groupings such that with respect to five pairs of first, second, third, fourth and fifth openings consecutively adjacent to each other in a column, the pair of first and second openings have a closer vertical spacing relative to the second and third openings and the pair of third and fourth openings have a closer vertical spacing relative to the fourth and fifth openings whereby separation is reduced between tip and ring conductors of a pair of wires and separation is increased between respective paris of wire terminated in said terminal clips;

a terminal clip received in each of said openings, said terminal clip including;

(a) a flat body having a base;

(b) a pair of opposed resilient arms extending upwardly from said base, each of said arms having a lower section and an upper section, each of said lower sections having an inner side surface and an outer side surface, said inner side surfaces of said lower sections being in facing relation to each other, said upper sections of said opposed arms cooperating to define (1) a wire retention section of the clip and (2) a conductor receiving slot;

(c) an aperture between said lower sections of said opposed arms, said aperture extending vertically between said base and said conductor receiving slot.

16. The terminal block assembly of claim 15 wherein:

said ribs have alternating thicknesses in order to maintain said staggered groupings.

17. The terminal block assembly of claim 16 wherein:

the center spacing between openings alternates between about 0.188" and about 0.212" such that the center spacing between staggered pairs is maintained at about 0.40".

18. A method of manufacturing a terminal clip including the steps of:

stamping a flat body having a base and a pair of opposed resilient arms extending upwardly from said base, each of said arms having a lower section and an upper section, each of said lower sections having an inner side surface and an outer side surface, said inner side surfaces of said lower sections being in facing relation to each other, said upper sections of said opposed arms diverging outwardly from each other with an aperture being stamped between said lower section of said opposed arms, said aperture extending vertically between said base and opening into said diverging upper sections; and progressively closing said diverging upper sections to define a conductor receiving slot, said step of progressively closing further comprising the step of coining said lower sections to thrust said arms closed and provide preloading to said arms.

19. The method of claim 18 wherein:

said coins have a triangular shape.

20. The method of claim 18 wherein:

said coining is applied to opposed planar surfaces of said lower sections to minimize distortion.

21. A terminal clip made from the method of claim 18.

22. The method of claim 18 including the step of:

stamping an air gap bump in facing relation on inner side surfaces of each of said upper sections above said aperture wherein said air gap bumps maintain a spacing between said upper sections to define said conductor receiving slot.

23. A terminal clip made from the method of claim 22.

24. The method of claim 18 wherein said coining step further comprises:

downwardly coining outer edges of said lower sections.

25. A terminal clip made from the method of claim 24.

26. A method of manufacturing a terminal clip including the steps of:

stamping a flat body having a base and a pair of opposed resilient arms extending upwardly from said base, each of said arms having a lower section and an upper section, each of said lower sections having an inner side surface and an outer side surface, said inner side surfaces of said lower sections being in facing relation to each other, said upper sections of said opposed arms cooperating to define a conductor receiving slot with an aperture between said lower sections of said opposed arms, said aperture extending vertically between said base and said conductor receiving slot; and downwardly coining outer edges of said lower sections to thrust said arms closed and provide preloading to said arms.

27. The method of claim 26 wherein:

said coins have a triangular shape.

28. The method of claim 26 wherein:

said coining is applied to opposed planar surfaces of said lower sections to minimize distortion.

29. A terminal clip comprising:

a flat body having a base;

a pair of opposed resilient arms extending upwardly from said base, each of said arms having a lower section and an upper section, each of said lower sections having an inner side surface and an outer side surface, said inner side surfaces of said lower sections being in facing relation to each other, said upper sections of said opposed arms cooperating to define a conductor receiving slot;

an aperture between said lower sections of said opposed arms, said aperture extending vertically between said base and said conductor receiving slot;

said lower sections being coined to provide preloading to said arms.

30. The clip of claim 29 wherein:

said coins have a triangular shape.

31. The clip of claim 29 wherein:

said coining is applied to opposed planar surfaces of said lower sections to minimize distortion.

32. The clip of claim 29 wherein:

outer edges of said lower sections are coined to provide said prelaod to said arms.

* * * * *